US005449093A

United States Patent [19]

Burrows

[11] Patent Number: 5,449,093

[45] **Date of Patent: * Sep. 12, 1995**

[54] BOTTLED WATER STATION WITH REMOVABLE RESERVOIR

[75] Inventor: Bruce D. Burrows, Valencia, Calif.

[73] Assignees: Ebtech, Inc.; Ohio Corporation, both of Columbus, Ohio

[ * ] Notice: The portion of the term of this patent subsequent to Mar. 1, 2001 has been disclaimed.

[21] Appl. No.: 270,776

[22] Filed: Jul. 5, 1994

Related U.S. Application Data

[63] Continuation of Ser. No. 201,206, Feb. 24, 1994, Pat. No. 5,370,276, which is a continuation-in-part of Ser. No. 64,921, May 24, 1993, Pat. No. 5,289,951, which is a continuation-in-part of Ser. No. 955,330, Oct. 1, 1992, Pat. No. 5,246,141, which is a continuation-in-part of Ser. No. 688,861, Apr. 22, 1991, Pat. No. 5,192,004.

[51] Int. Cl.[6] ..... B67D 5/62

[52] U.S. Cl. ..... 222/146.1; 222/146.6; 222/185.1; 62/390

[58] Field of Search ..... 222/146.1, 146.2, 146.5, 222/146.6, 185; 62/390, 395

[56] References Cited

U.S. PATENT DOCUMENTS

| | | | |
|---|---|---|---|
| 2,657,554 | 11/1953 | Hull | 222/146.1 |
| 3,333,438 | 8/1967 | Benua et al. | 222/146.1 |
| 3,698,603 | 10/1972 | Radcliffe | 222/146.1 |
| 4,629,096 | 12/1986 | Schroer et al. | 222/146.6 |
| 4,779,426 | 10/1988 | Desrosiers | 62/395 |
| 4,792,059 | 12/1988 | Kerner et al. | 222/146.1 |

*Primary Examiner*—Andres Kashnikow
*Assistant Examiner*—Lesley D. Morris
*Attorney, Agent, or Firm*—Kelly Bauersfeld & Lowry

[57] ABSTRACT

An improved bottled water station includes a removable reservoir for drop-in installation into and lift-out removal from a station housing. The reservoir is constructed from a lightweight molded plastic or the like to have an open upper end for receiving and supporting an inverted water bottle. A bottom wall on the reservoir includes an upwardly recessed portion defining an inverted receiver cup for slide-fit reception of a chiller probe provided as part of a refrigeration system on the station housing. One or more faucet valves are provided to extend through openings in a front wall of the station housing for dispensing water from the reservoir.

6 Claims, 5 Drawing Sheets

56
64
60
58
14
54
62
24
20
74
66
41
44
18'
18
52
32
46
48
16
30
44
40
33
34
45
42
36
38
REFRIGERATION SYSTEM
22

BOTTLED WATER STATION WITH REMOVABLE RESERVOIR

BACKGROUND OF THE INVENTION

This is a continuation of application Ser. No. 08/201,206, filed Feb. 24, 1994, now U.S. Pat. No. 5,370,276, which is a continuation-in-part of U.S. Ser. No. 08/064,921, filed May 24, 1993, now issued as U.S. Pat. No. 5,289,951, issued Mar. 1, 1994, which is a continuation-in-part of U.S. Ser. No. 07/955,330, filed Oct. 1, 1992, now issued as U.S. Pat. No. 5,246,141, issued Sep. 21, 1993, which is in turn a continuation-in-part of U.S. Ser. No. 07/688,861, filed Apr. 22, 1991, now issued as U.S. Pat. No. 5,192,004, issued Mar. 9, 1993.

This invention relates generally to improvements in bottled water stations of the type adapted to receive and support a water bottle in an inverted position, and to selectively dispense water therefrom. More specifically, this invention relates to an improved bottled water station having a removable water-containing reservoir adapted for simple drop-in installation into a station housing, wherein the reservoir and station housing include vapor seal means for substantially eliminating or preventing formation of undesired condensation and/or frost on the exterior of the water reservoir.

Bottled water dispenser stations are well-known in the art for containing a supply of relatively purified water in a convenient manner and location ready for substantially immediate dispensing and use. Such bottled water stations commonly include an upwardly open reservoir mounted on a station housing and adapted to receive and support an inverted water bottle of typically three to five gallon capacity. Water within the inverted bottle flows downwardly into the station reservoir for selective dispensing therefrom through one or more faucet valves on the front of the station housing. Such bottled water stations are widely used to provide a clean and safe source of water for drinking and cooking, especially in areas where the local water supply is suspected to contain undesired levels of contaminants.

In bottled water stations of the above-described type, the water bottles are normally provided by a vendor in a clean and preferably sterile condition with an appropriate sealed cap to prevent contamination of the water contained therein. When an inverted bottle on a station housing reaches an empty condition, the empty bottle can be lifted quickly and easily from the station housing and replaced by a filled bottle having the sealing cap removed therefrom. The empty bottle can then be returned to the bottled water vendor for cleaning and refilling.

Although bottled water stations of this type utilize a sequence of water bottles which have been individually sanitized, the water reservoir within the station housing has not been subjected to periodic cleaning or replacement. In this regard, the housing reservoir typically comprises a metal or ceramic tank mounted within the station housing in association with a refrigeration system having a chiller coil for maintaining water within the reservoir in a chilled condition. In some station housing designs, the reservoir is subdivided into distinct chambers, one of which is associated with a refrigeration system, to provide separately dispensed supplies of chilled water and room temperature water. Still further, in other designs, an auxiliary reservoir is provided in association with suitable heated elements to produce a heated water supply. Unfortunately, the integration of the station housing reservoir with associated chilling and/or heating systems has generally precluded easy access to or removal of the reservoir from the station housing for cleaning purposes. Instead, the water-containing reservoir has typically been used for prolonged time periods without cleaning, thus creating the potential for undesired growth of harmful bacteria and other organisms. Reservoir cleaning has generally been accomplished in the past by taking the station out of service and returning the station to a centralized facility for cleaning purposes.

In one proposed construction for a bottled water station, a removable reservoir container has been suggested for drop-in placement and lift-out removal with respect to a supporting chiller plate mounted within a station housing. See, for example, U.S. Pat. No. 4,629,096. While this configuration beneficially facilitates removal of the reservoir container for cleaning purposes, significant problems have been encountered with respect to formation of condensation and/or frost in the space between the removable reservoir container and the refrigerated chiller plate. As a result, such bottled water stations have encountered significant drip problems requiring inclusion of a drip tray, and often resulting in undesirable water puddling on the floor beneath the station housing. Condensate dripping onto carpeted or tiled floor areas in a typical in-home or office environment is, of course, extremely undesirable.

In an alternative and improved bottled water station construction having a drop-in, lift-out reservoir, a chiller probe on the bottled water station is adapted for slide-fit sealed reception through an opening formed in a bottom wall of the reservoir. See, for example, U.S. Pat. No. 5,192,004. In this construction, the chiller probe is positioned within the interior volume of the removable reservoir, in direct contact with water contained therein, whereby problems relating to condensation and/or frost are entirely avoided. However, an adequate and reliable slide-fit seal arrangement must be provided between the reservoir bottom wall and the chiller probe to prevent undesired water leakage.

The present invention overcomes the problems and disadvantages and related concerns encountered in the prior art in connection with a bottled water station having a removable water-containing reservoir, wherein the reservoir is designed for snug slide-fit engagement with a chiller probe of a refrigeration system without requiring a probe-receiving opening to be formed in the reservoir, and further in a manner which substantially eliminates or prevents formation of undesired condensation and or frost.

SUMMARY OF THE INVENTION

In accordance with the invention, an improved bottled water station includes a removable reservoir for drop-in, slide-fit installation into a station housing, and for receiving and supporting a water supply bottle in an inverted position. The reservoir may be constructed from a lightweight molded plastic or the like, and includes a bottom wall having an upwardly recessed portion defining an inverted receiver cup for close, substantially mated slide-fit reception of an upstanding chiller probe provided as part of a refrigeration system on the station housing. Vapor seal means are effectively provided to prevent air circulation into the space between the chiller probe and the receiver cup, thereby substantially preventing and/or eliminating formation and/or accumulation of condensation and frost.

In the preferred form, the chiller probe includes a probe shell of upstanding cylindrical shape with a chiller coil mounted therein. A heat transfer plate is provided at the top of the chiller coil to assist heat transfer between the coil and the probe shell. In addition, the residual volume within the probe shell is desirably filled with a thermal mastic or gel substance to further assist heat transfer between the chiller coil and the probe shell. The external shape of the probe shell is designed for snug close-fit reception into the receiver cup at the bottom of the reservoir, whereby the chiller probe effectively and efficiently chills the water within the reservoir. The close-fitting geometries of the probe shell and the reservoir cup effectively prevents air circulation and resultant frost formation therebetween.

In one form a vapor seal means is provided as a seal ring carried on the removable reservoir in a position disposed generally at the lower entrance end of the receiver cup. The seal ring, in one form, defines a downwardly protruding knifelike seal edge for press-fit engagement with an insulation panel mounted within the station housing on a horizontal support platform. The chiller probe protrudes upwardly through the support platform and insulation panel for slide-fit reception into the reservoir receiver cup. In an alternative form of the invention, the seal ring is carried within the receiver cup generally at the lowermost, entrance end thereof. The seal ring includes a radially inwardly protruding annular lip for sealed, slide-fit engagement with the chiller probe at or near a lower end of probe.

In a further alternative form of the invention, the vapor seal means comprises a thermal mastic or viscous gel material applied to the interior of the receiver cup and/or to the probe to substantially fill the space therebetween when the reservoir is mounted into the station housing. The thermal mastic material provides improved heat transfer between the chiller probe and the receiver cup, while preventing air circulation between these components, wherein such air circulation could otherwise contribute to formation of condensation and/or frost.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
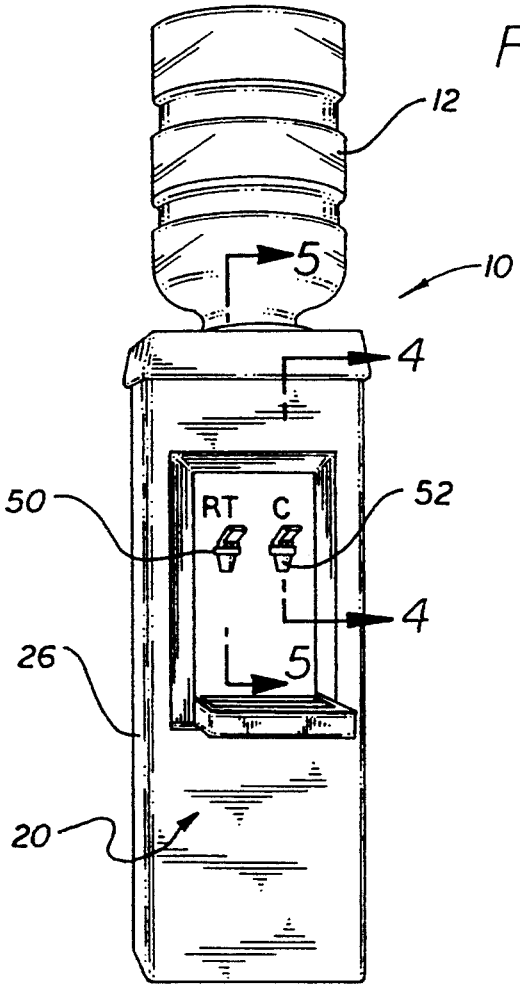
FIG. 1 is a front perspective view illustrating a bottled water dispenser station adapted for use with a removable reservoir of a type embodying the novel features of the invention.
Figure 4:
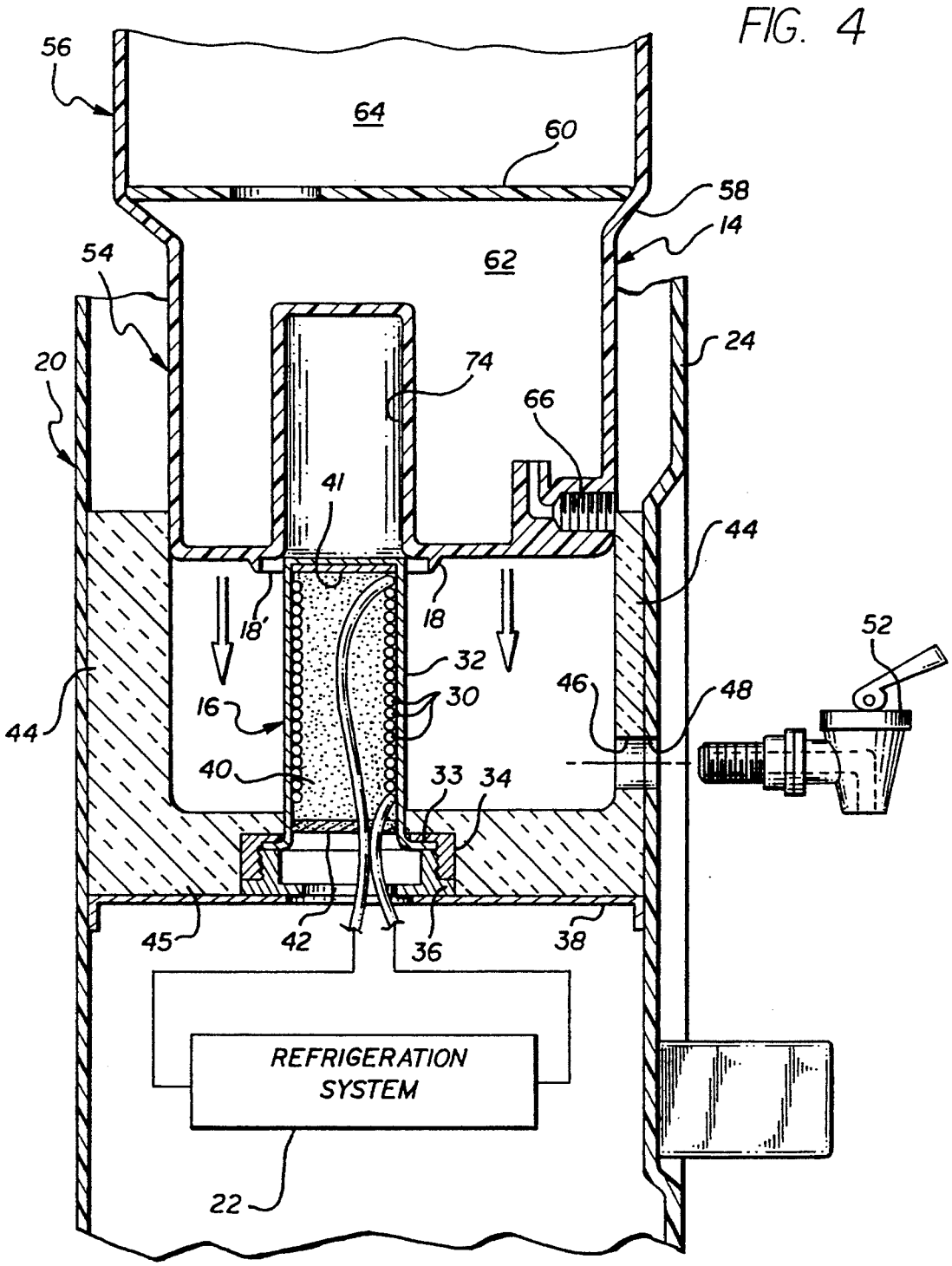
FIG. 4 is an enlarged fragmented vertical sectional view taken generally on the line 4—4 of FIG. 1, and illustrating slide-in installation of the reservoir of FIG. 3 into the station housing.
Figure 5:
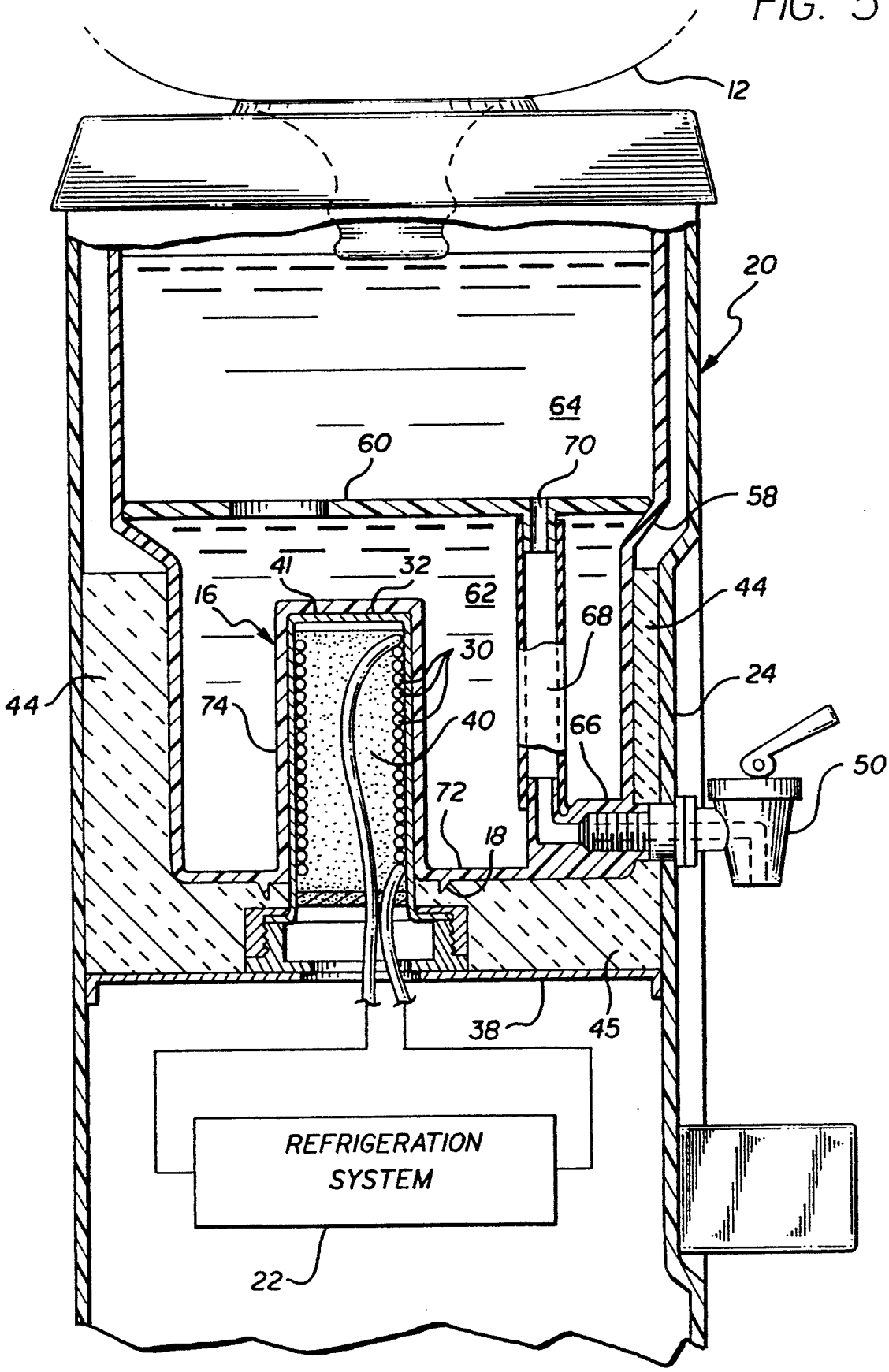
FIG. 5 is an enlarged fragmented sectional view taken generally on the line 5—5 of FIG. 1, and illustrating the removable reservoir installed into the station housing.
Figure 6:
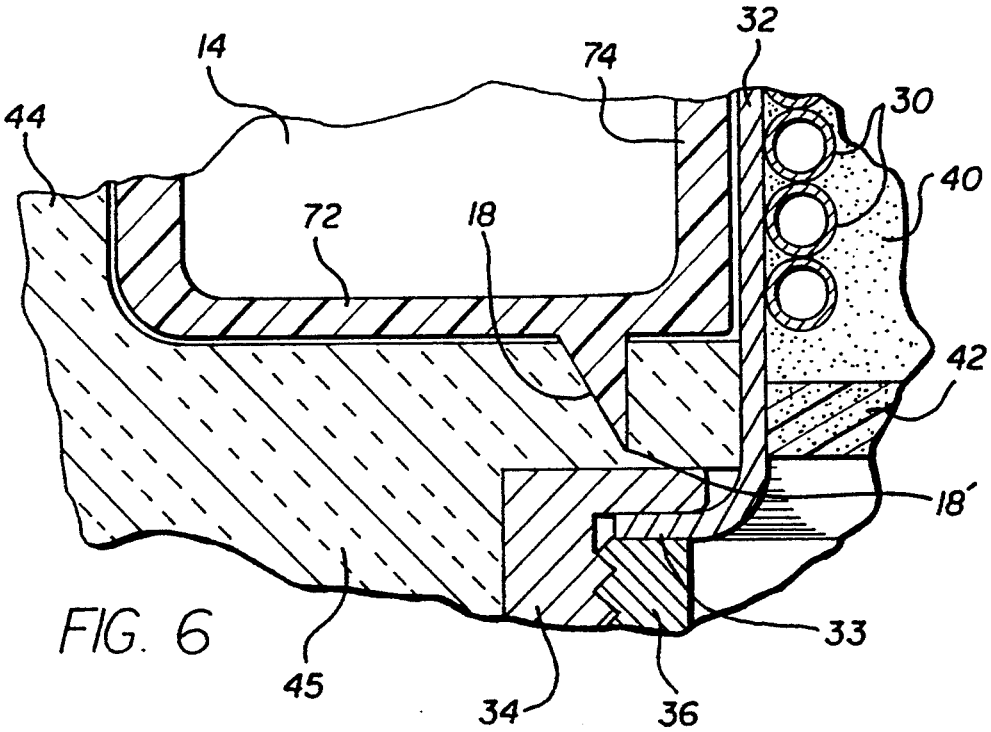
FIG. 6 is an enlarged fragmented sectional view corresponding generally with the encircled region 6 of the FIG. 5.

As shown in the exemplary drawings, a bottled water station referred to generally in FIG. 1 by the reference numeral 10 is provided for receiving and supporting a water bottle 12 containing a supply of relatively purified water for drinking and cooking uses, etc. The bottled water station 10 includes a removable reservoir 14 (FIGS. 3–5) adapted for drop-in installation into and slide-out removal from the bottled water station 10, thereby permitting quick and easy removal of the reservoir 14 for cleaning and replacement. The reservoir 14 is designed for close slide-fit engagement with an upstanding chiller probe 16 (FIG. 2) within the bottled water station for chilling water within the removable reservoir 14. A vapor seal 18 (FIGS. 3–6) prevents air circulation into the space between the reservoir 14 and the chiller probe 16, thereby substantially preventing or eliminating undesired formation and/or accumulation of condensation or frost.

The illustrative bottled water station has a generally conventional overall size and shape to include an upstanding cabinet or housing 20. This station housing 20, in combination with the removable reservoir 14 to be described in more detail, supports the water bottle 12 in an inverted orientation such that water contained therein will flow downwardly by gravity into the reservoir 14. The chiller probe 16 is provided as part of a refrigeration system 22 (FIG. 4 and 5) for reducing the temperature level of water contain ed within at least a portion of the reservoir 14 to a chilled and refreshing beverage temperature, typically on the order of about 40–50 degrees Fahrenheit. The water within the reservoir is adapted for quick and easy dispensing from one or more faucet valves mounted in accessible positions on a front wall 24 of the station housing 20.

Figure 2:
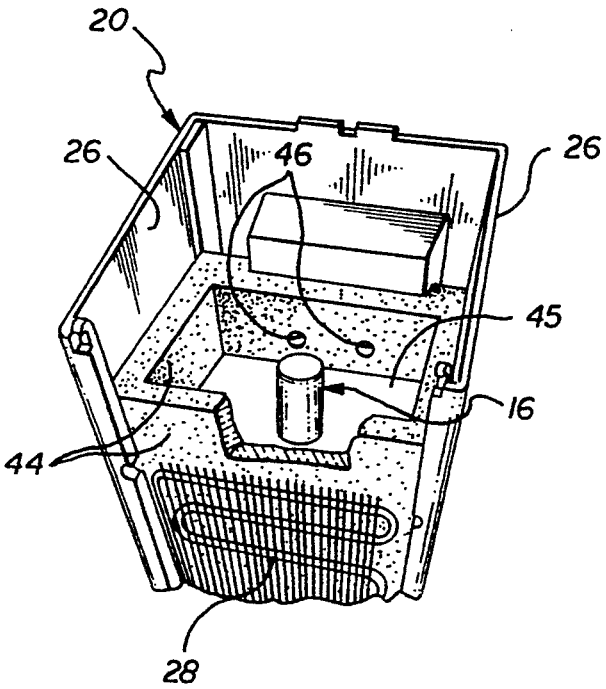
FIG. 2 is an enlarged rear perspective view of the station housing, with the removable reservoir separated therefrom.
Figure 3:
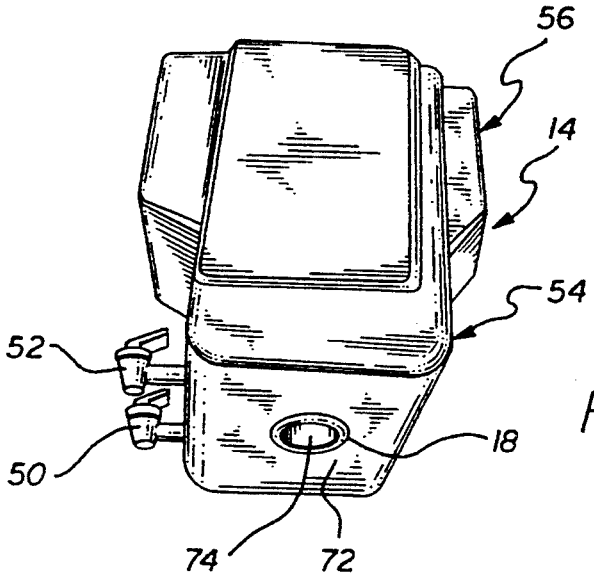
FIG. 3 is an enlarged bottom perspective view depicting one preferred form of the removable reservoir of the present invention.

With reference to FIGS. 1–3 the station housing 20 is shown to have an upstanding, generally rectangular configuration to include the front wall 24 joined to a pair of housing side walls 26, and a housing back which has a typically open construction (FIG. 2). The refrigeration system 22 is normally mounted within a lower portion of the housing interior and comprises a conventional compressor (not shown) for circulating a refrigerant through a closed loop cycle including, for example, finned heat transfer tubing 28 mounted across the open back of the station housing 20. A chiller coil 30 (FIGS. 4 and 5) of copper tubing or the like is wrapped within the interior of an inverted, generally cup-shaped probe shell 32. The probe shell includes an outwardly radiating lower flange 33 retained by a mounting ring 34 on a collar 36 which is supported in turn on a horizontally oriented support platform 38 within the station housing. The chiller probe thus protrudes upwardly from the support platform 38, with the chiller coil 30 wrapped spirally therein.

In the preferred form, the residual volume of the interior of the probe shell 32 is occupied by a thermal mastic material 40 in the form of a viscous or gel material chosen for relatively efficient heat transfer properties, such as a polymeric heat transfer compound of the type marketed by Presstite Division of Inmont Corporation, St. Louis, Mo., under the name Presstite Thermal Mastic. A retainer disk 42 of foam material or the like can be press-fitted into the lower end of the probe shell 32 to ensure retention of the mastic material 40 therein.

In addition, in the preferred form, the probe shell 32 is formed from a lightweight molded plastic material. The thermal mastic material 40 promotes sufficient heat transfer between the coil 30 and the plastic probe shell 32, to obtain satisfactory water chilling as will be described in more detail. A heat transfer plate 41 of a metal such as copper is installed within the probe shell 32 at the top of the coil 30, in close thermal contact with the top of the probe shell, and has been found to provide significantly further improved heat transfer between the coil 30 and the water.

Insulation panels 44 of closed cell styrofoam or other suitable insulative material are arranged within the station housing 20 in an upwardly open, generally rectangular or box-like receptacle. These insulation panels include a floor panel 45 rested on the support platform 38, with the chiller probe 16 protruding upwardly therefrom, in combination with four upstanding side walls which line the rectangular interior of the station housing. The insulation panels are designed for thermally insulating a lower portion of the removable reservoir 14, wherein chilled water is retained within this lower portion of the reservoir, as will be described in more detail. A pair of faucet ports 46 (FIG. 2) are formed in the one of the insulation panels 44 lining the front wall 24 of the housing, in alignment with corresponding faucet ports 48 in said front wall 24, to accommodate mounting of water dispense faucets 50 and 52.

The removable reservoir 14 may be constructed conveniently and economically from a lightweight molded plastic or the like, such as polyethylene with an overall size and shape for relative snug-fit reception into the station housing. In this regard, the reservoir 14 includes a lower portion identified by reference arrow 54, of reduced cross-sectional geometry for relatively snug-fit reception into the box-like structure defined by the insulation panels 44. An upper portion 56 of the reservoir 14 has an expanded cross-sectional size to define an outwardly protruding transition shoulder 58 (FIGS. 4 and 5) upon which a perforated baffle plate 60 can b e in stalled within the reservoir interior. The baffle plate subdivides the interior of the reservoir into a lower chamber 62 and an upper chamber 64. A pair of faucet fittings 66 are provided at a front wall of the reservoir for thread-in mounting of the faucets 50, 52. As shown best in FIGS. 4 and 5, one of the faucet fittings 66 is in direct flow communication with the lower reservoir chamber 62, whereas the other faucet fitting is in flow communication with the upper reservoir chamber 64 via a hollow standpipe 68 which extends upwardly through a port 70 in the baffle plate 60.

A bottom wall 72 of the removable reservoir 14 is configured for slide-fit engagement with the upstanding chiller probe 16, when the reservoir is slide- fit in stalled into the station housing 20. More particularly, the bottom wall 72 of the reservoir 14 includes an upwardly recessed portion defining an inverted receiver cup 74 having a size and shape for relatively close-fit, substantially mated press-in reception of the chiller probe 16. The probe 16 may be designed for minor lateral movement relative to the mounting ring 34 and collar 36 to facilitate self-aligned probe reception into the receiver cup. The receiver cup 74 thus defines an upstanding cylindrical wall having an upper end closed by a circular end wall, such that the cup 74 protrudes into the volumetric space of the lower reservoir chamber 62, without providing any open flow port.

The close-fit relation between the probe 16 and the receiver cup 74 provides efficient thermal communication for chilling water within the lower reservoir chamber 62, permitting the probe shell 32 to be formed of metal or plastic. This close-fit geometry effectively precludes air circulation and resultant frost formation between the probe and the reservoir cup.

In accordance with one form of the invention, the vapor seal 18 may be additionally provided to prevent air circulation into the residual space between the chiller probe 16 and the reservoir walls defining the receiver cup 74. As shown in FIGS. 3–6, the vapor seal 18 comprises an integrally molded seal ring formed on the bottom wall 72 of the reservoir 14, to protrude downwardly from the reservoir bottom wall at a position surrounding and closely adjacent to the open lower end of the receiver cup 74. In a preferred configuration, the seal ring 18 defines an annular knife edge 18′ which compresses and/or cuts into the underlying insulation panel 45, as the reservoir 14 is installed into the bottled water station. The vapor seal 18 functions, particularly when closed cell foam is used for the insulation panels, to prevent air circulation between the refrigerated exterior surface of the chiller probe 16 and the interior surface of the receiver cup 74. With this construction, formation of condensate and/or frost, and particularly accumulation thereof, at the interface between the probe 16 and the reservoir 14 are substantially prevented. Thus, dripping problems encountered in the prior art with respect to accumulation of condensation or frost are substantially avoided.

Figure 7:
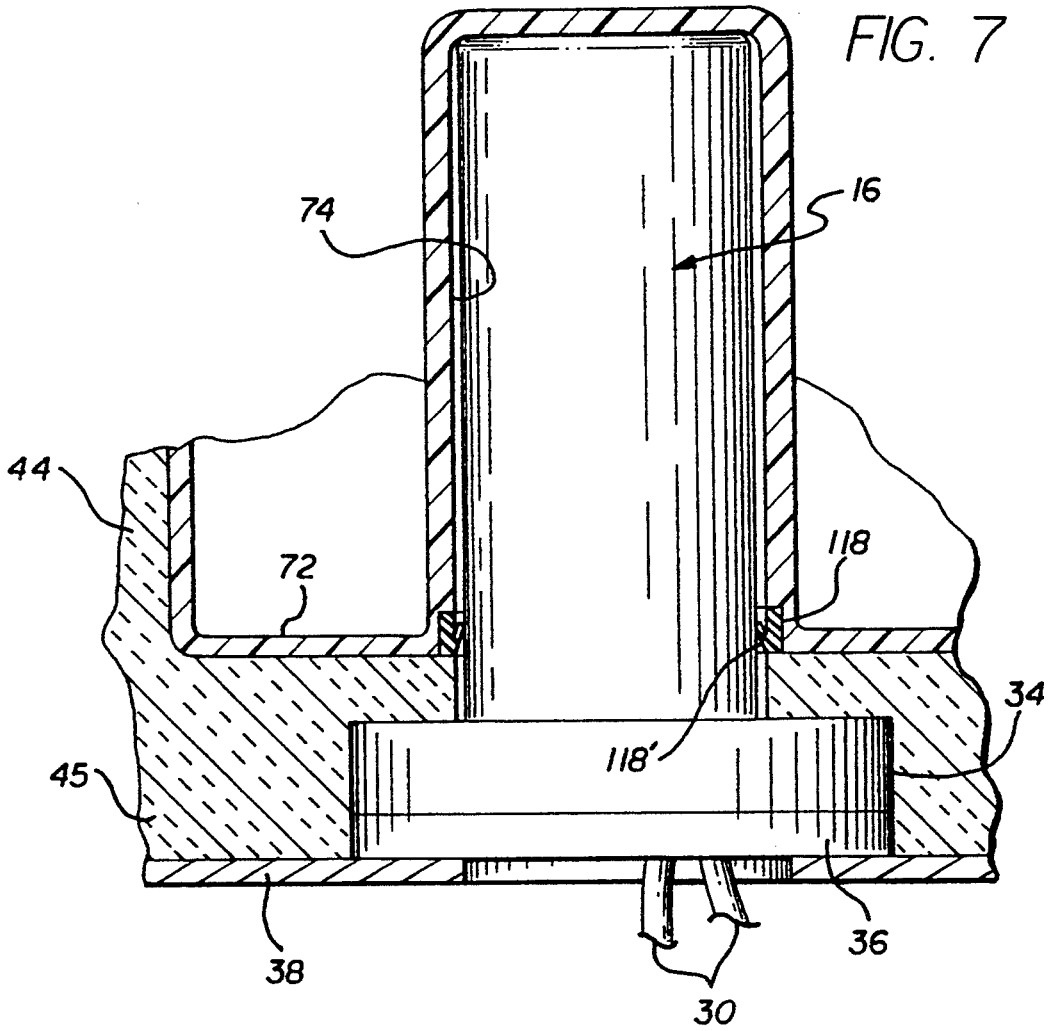
FIG. 7 is a fragmented vertical sectional view illustrating an alternative preferred form of the invention.

FIG. 7 illustrates one alternative form of the invention, wherein a modified vapor seal ring 118 is provided for sealed-fit engagement with the chiller probe 16, at a position located generally at the open lower end of the receiver cup 74. The vapor seal ring 118 may be integrally molded with the reservoir 14, or otherwise installed as separate component as by sonic welding, to define an inwardly radiating lip seal 118′ for press-fit sealed engagement with the probe 16. Once again, as described with respect to FIGS. 1–6, the vapor seal ring 118 effectively prevents any significant air circulation to the space between the probe 14 and the reservoir cup 74, thereby preventing formation of the undesired condensation and/or frost.

Figure 8:
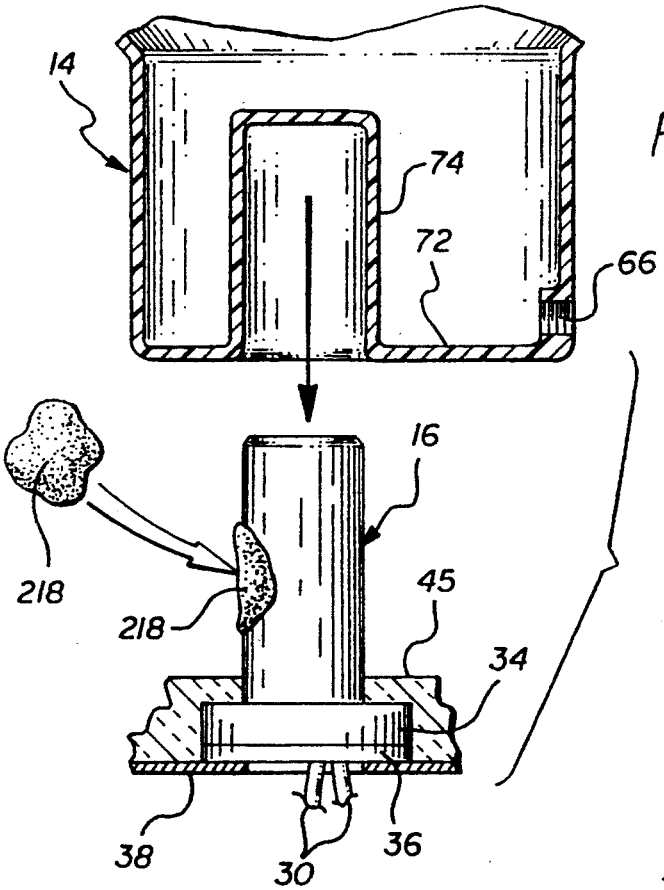
FIG. 8 is a fragmented exploded perspective view illustrating another alternative preferred form of the invention, and depicting slide-fit mounting of a removable reservoir onto a chiller probe within the station housing.
Figure 10:
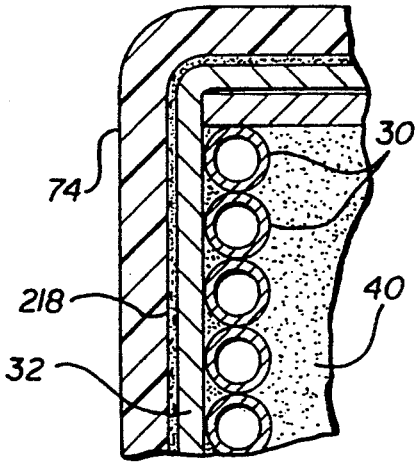
FIG. 10 is an enlarged fragmented sectional view corresponding generally with the encircled region 10 of FIG. 9.
Figure 9:
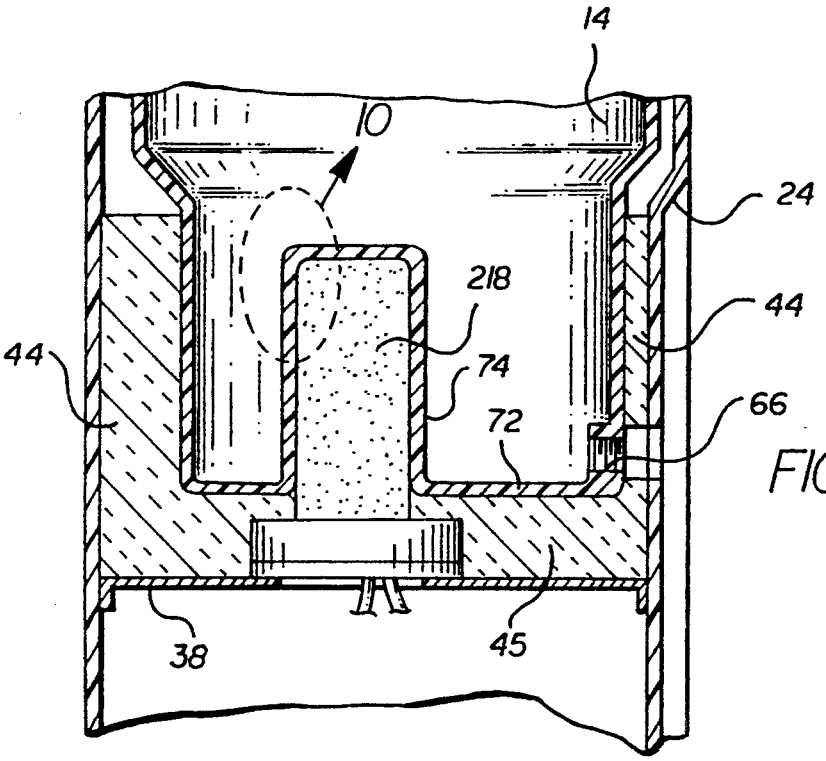
FIG. 9 is a fragmented sectional view of the embodiment shown in FIG. 8, and illustrating seated installation of the reservoir into the station housing.

FIGS. 8–10 illustrate a further alternative form of the invention, wherein the vapor seal 218 comprises an additional quantity of a thermal heat transfer material such as the thermal mastic material 40, described previously for placement into the interior of the probe shell 32. More particularly, a film or layer of the thermal mastic material 218 is applied to the exterior of chiller probe 16, or alternately to the surfaces on the portion of the reservoir defining the receiver cup 74. With this arrangement, the thermal mastic material 218 occupies the residual space between the chiller probe 16 and the receiver cup 74, thereby displacing air from that residual space. As a result, in the absence of air or circulation thereof at the probe-cup interface, formation of condensation and/or frost on the exterior of the reservoir 14 is substantially avoided.

A variety of further modifications and improvements to the invention will be apparent to those skilled in the art. Accordingly, no limitation on the invention is intended by way of the foregoing description and accompanying drawings, except as set forth in the appended claims.

What is claimed is:

1. A water station, comprising:

a reservoir having a hollow interior for receiving and storing a supply of water, said reservoir having a bottom wall with an inverted receiver cup formed therein;

a station housing having support means for receiving and supporting said reservoir;

a chiller probe comprising a probe shell with a chiller member therein, said chiller probe being mounted within said station housing and projecting upwardly from said support means for slide-fit and substantially mated reception of said probe shell into said receiver cup when said reservoir is mounted within said station housing, said probe shell defining a chilled surface for surface-to-surface contacting of said receiver cup to chill water within said reservoir; and faucet means for dispensing water from said reservoir.

2. The water station of claim 1 wherein said housing support means defines an upwardly open cavity for drop-in installation and slide-out removal of said reservoir.

3. The water station of claim 1 including insulation means within said cavity and defining an upwardly open insulated receptacle for receiving at least a portion of said reservoir.

4. The water station of claim 1 wherein said reservoir is adapted to receive the supply of water from an inverted water bottle mounted on said station housing.

5. The water station of claim 1 further including a thermal heat transfer material within said probe shell substantially filling the residual space between said chiller member and said probe shell.

6. The water station of claim 5 wherein said probe shell is formed from a plastic material.

* * * * *

UNITED STATES PATENT AND TRADEMARK OFFICE

CERTIFICATE OF CORRECTION

PATENT NO. : 5,449,093
DATED : September 12, 1995
INVENTOR(S) : Bruce D. Burrows It is certified that error appears in the above-identified patent and that said Letters Patent is hereby corrected as shown below:

Title page,
Item [*] Notice, change the disclaimer to read -- The portion of the term of this patent subsequent to Mar. 1, 2011 has been disclaimed --

Signed and Sealed this

Twenty-eighth Day of September, 2004

JON W. DUDAS
*Director of the United States Patent and Trademark Office*